United States Patent [19]

Boeshart

[11] Patent Number: 4,765,109

[45] Date of Patent: Aug. 23, 1988

[54] ADJUSTABLE TIE

[76] Inventor: Patrick E. Boeshart, R.R. 1, Box 134, Sioux City, Iowa 51108

[21] Appl. No.: 101,055

[22] Filed: Sep. 25, 1987

[51] Int. Cl.[4] ..... E04B 2/00

[52] U.S. Cl. ..... 52/426; 52/562

[58] Field of Search ..... 52/426, 425, 428, 562, 52/563, 564, 565; 24/578, 579, 575, 580

[56] References Cited

U.S. PATENT DOCUMENTS

| | | | |
|---|---|---|---|
| 963,776 | 7/1910 | Kosack | 52/426 |
| 1,953,287 | 4/1934 | Bemis | 52/428 |
| 1,962,906 | 6/1934 | Mueller | 52/564 |
| 2,919,572 | 1/1960 | Salzi | 52/564 |
| 3,788,020 | 1/1974 | Gregori | 52/426 |
| 4,655,014 | 4/1987 | Krecke | 52/426 |
| 4,698,947 | 10/1987 | McKay | 52/426 |
| 4,706,429 | 11/1987 | Young | 52/309 |

FOREIGN PATENT DOCUMENTS

| | | | |
|---|---|---|---|
| 263323 | 7/1968 | Austria | 52/562 |
| 542144 | 11/1955 | Belgium | 52/426 |
| 2029175 | 6/1972 | Fed. Rep. of Germany | 52/426 |
| 2317207 | 10/1974 | Fed. Rep. of Germany | 52/426 |
| 144004 | 6/1920 | United Kingdom | 52/562 |
| 160228 | 3/1921 | United Kingdom | 24/578 |

*Primary Examiner*—Henry E. Raduazo

*Attorney, Agent, or Firm*—Zarley, McKee, Thomte, Voorhees & Sease

[57] ABSTRACT

An adjustable tie includes a pair of straps selectively connected together to form a single tie. Each of the pair of straps has a pair of spaced-apart plates at the outer end which will hold the panel of a wall form therebetween. Slots cut in the panels allow the tie ends to be inserted in the panels. The pair of straps which form each tie are identical, and have a series of pegs and apertures which are cooperable in selected positions to vary the length of the tie. In a second embodiment, the portion of each strap between the inner and outer plates is comprised of two interconnecting pieces so that the distance between the plates is adjustable, to allow for various panel thicknesses.

8 Claims, 2 Drawing Sheets

ADJUSTABLE TIE

TECHNICAL FIELD

This invention relates generally to ties for poured concrete wall systems, and more particularly to an improved tie which has an adjustable length.

BACKGROUND OF THE INVENTION

While wall forming systems have been in use for many years, a recent development in this industry is in the use of expanded polystyrene panels as forms for the poured concrete walls. After the concrete has hardened, the panels are left in place on the walls to serve as permanent insulation.

This new wall system utilizes a system of "blocks", each block comprised of a pair of polystyrene panels connected in parallel spaced-apart alignment by a series of rigid plastic ties between the panels. Each panel has a series of T-shaped slots along its upper and lower edges, into which the T-shaped end of the plastic ties would be inserted to "lock" the panels into a block. The panels further utilize a corrugated or striated innerface, and a smooth outer face. The upper, lower and side edges all have tongue and groove elements so that a series of blocks can be stacked and locked together to create forms for a wall. Concrete is then poured between the panels, the hardened concrete adhering to the panels and to the corrugations on the inside surfaces of the panels. Since the T-shaped ends of the ties do not extend completely through the panels, a smooth panel surface would face the exterior of the wall and could be finished as desired. The panels thereby provide a form for pouring the concrete as well as an insulated wall once the concrete has hardened.

While this insulation panel system has proved quite successful, the system is limited by the fact that the panels must be left in place on the concrete wall. This system is not capable of use on those occasions where an exposed concrete surface is desired. Thus it was necessary to revert to the older methods of form boards, steel bracing within the concrete, and exterior bracing to hold the form boards in the appropriate alignment. Such a system is cumbersome, utilizes heavy materials, and is difficult to utilize to produce accurately aligned walls.

A further problem with the insulated panel system of the prior art is in the expense of manufacturing a specific length of tie for every desired width of wall to be poured. While the ties themselves are relatively inexpensive, the contractor would quite often end up with a large volume of extra ties in many different sizes, and would be forced to carry many sizes of such ties to every site at which concrete was to be poured.

The prior art insulated panel wall system also utilizes only a single thickness panel in the system. Thus, any additional insulation that may be desired after the wall is prepared, requires an additional construction expense, and in some cases requires the construction of another "wall" in order to obtain an appropriate surface for the desired finish.

The ties utilized in the prior art insulated panel system also limited the construction technique and possibilities for the panel system. In those instances where a conduit or pipe is intended to be incorporated within a wall to be newly poured, the "blocks" of panels and ties cannot be utilized to surround the pipe. A special assembly would be necessary in such a situation.

It is therefore a general object of the present invention to provide an improved tie for use in panel-type forms for poured concrete walls.

Another object is to provide a tie which is adjustable in length to accommodate a variety of wall thicknesses.

Another object of the present invention is to provide a tie which has adjustable-length panel-holding ends, to accommodate a variety of panel thicknesses.

Still another object is to provide a two-piece tie with identical, connectable halves.

A further object of the present invention is to provide a two-piece tie which is connectable in a variety of lengths.

Yet a further object of the present invention is to provide a tie which may be utilized in combination with prior art insulated panels as well as new types of panels utilized in poured concrete wall forms.

Another object of the present invention is to provide an adjustable tie which is inexpensive to manufacture, simple in design, and refined in appearance.

These and other objects will be apparent to those skilled in the art.

SUMMARY OF THE INVENTION

The adjustable tie of this invention includes a pair of straps which are selectively connected together to form a single tie of the desired length. Each of the pair of straps has a pair of spaced-apart plates at the outer end which will hold the panel of a wall-form therebetween. Slots cut in the panels allow the tie ends to be inserted and additional panels stacked on top to form an entire wall-form system. The pair of straps which form each tie are identical, and have a series of pegs and apertures which may be connected in selected positions to vary the length of the tie. In a second embodiment, the portion of each strap between the inner and outer plates is comprised of two interconnecting pieces so that the distance between the plates is adjustable, to allow for various panel thicknesses.

DESCRIPTION OF THE PREFERRED EMBODIMENT

Figure 1:
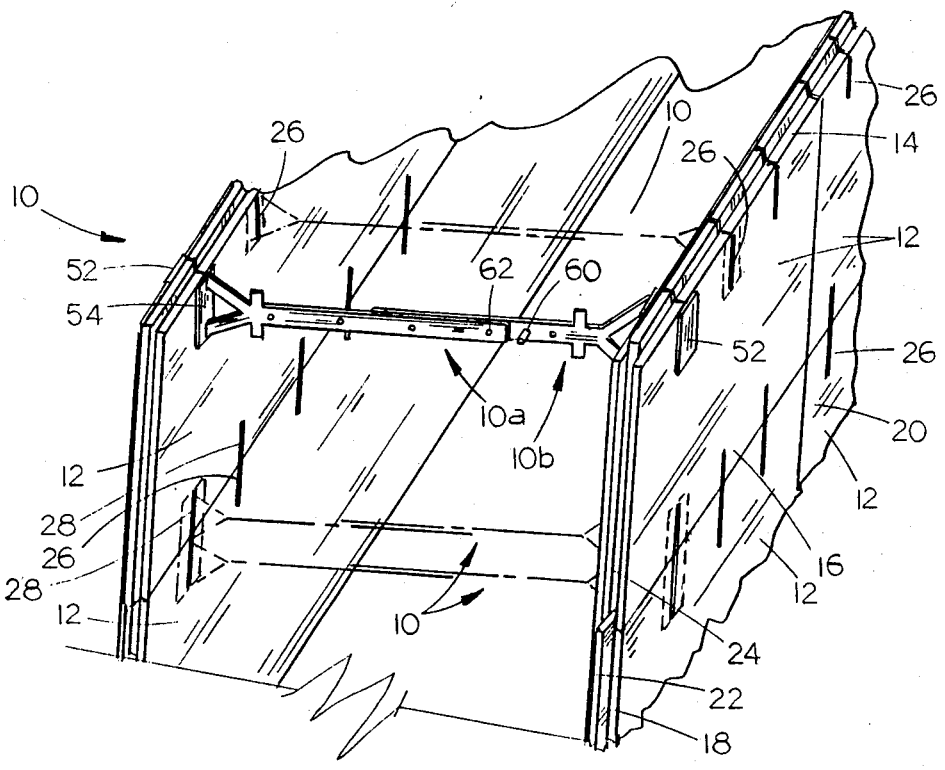
FIG. 1 is a perspective view of the tie of this invention installed in a wall form system, with additional ties shown in schematic form.
Figure 2:
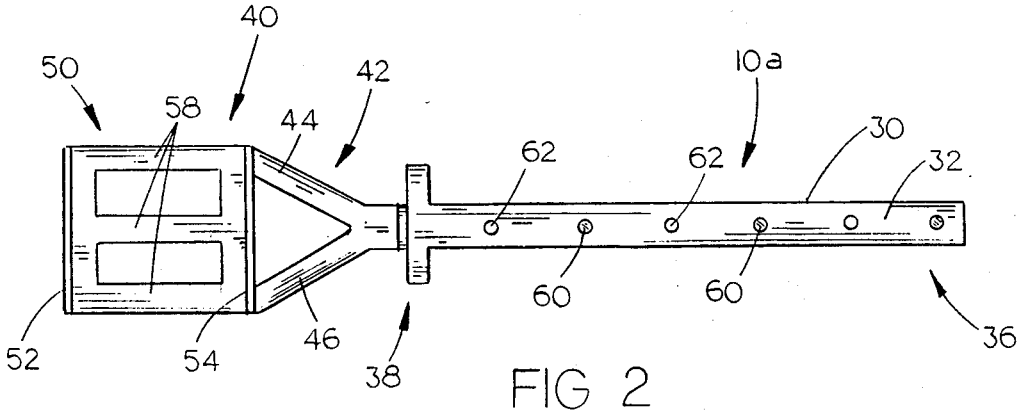
FIG. 2 is a side view of one half of the tie of this invention.
Figure 3:
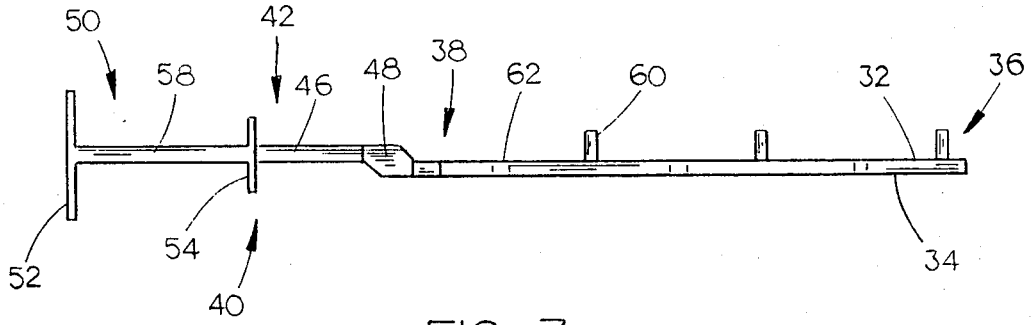
FIG. 3 is a top view of the tie in FIG. 2.

Referring now to the drawings, in which similar or corresponding parts are designated with the same reference numeral throughout the drawings, the adjustable tie of this invention is designated generally at 10 and is utilized in connecting a pair of wall forming panels 12. Each panel 12 has an upper edge 14, lower edge 16, and a pair of side edges 18 and 20. Each edge 14, 16, 18, and 20 has a tongue 22 or groove 24 centered therealong which may be removably connected to the corresponding tongue or groove of an adjoining panel 12, thereby interlocking the panels.

A series of slots 26 are cut downwardly in the upper edge 14 of each panel 12, and are evenly spaced therealong. A second series of slots 28 are cut upperwardly in the bottom edge 16 of each panel, the lower slots 28 being vertically aligned with upper slots 26. Slots 26 and 28 are cut to a depth sufficient to receive the end of tie 10, as seen in the drawings.

Tie 10 of this invention is composed of two identical halves 10*a* and 10*b*. For simplicity, only one half 10*a* will be described in detail, the other half being formed in exactly the same manner and having identical features.

Tie half 10*a* includes an elongated strap 30 having a generally rectangular cross section, opposing faces 32 and 34, and inner and outer ends 36 and 38 respectively. An end piece, designated generally at 40 is mounted to outer end 38 and is used to removably lock tie 10 to a panel 12. End piece 40 includes an inner section 42, comprised of a pair of legs 44 and 46 diverging from a junction 48 with outer end 38 of strap 30. An outer section 50 includes a pair of parallel and spaced apart plates 52 and 54, positioned perpendicularly to the longitudinal axis of strap 30 and attached to legs 44 and 46 at plate 54. Plates 52 and 54 are held in spaced apart relation by a set of three spaced apart legs 58. Legs 58 are rectangular in cross section and have a thickness equal to the thickness of legs 44 and 46 and equal to the thickness of strap 30. The length of legs 58 is determined by the thickness of the panel 12, which will fit between plates 52 and 54 as seen in FIG. 1.

A series of pegs 60 protrude perpendicularly from one face 32 of strap 30 a distance approximately equal to the thickness of legs 44, 46 and 58. Pegs 60 are evenly spaced along strap 30 with apertures 62 centered therebetween. Apertures 62 have a diameter equal to that of pegs 60, and cooperate with the pegs on the opposing identical half 10*b* of tie 10 to allow a variety of lengths of the connected tie halves 10*a* and 10*b*. In use, tie halves 10*a* and 10*b* are oonnected to obtain the desired distance between plate 54 on half 10*a* and plate 54 on half 10*b*. This distance will be the approximate thickness of the wall to be poured. Each tie 10 is then attached between a pair of panels 12 by inserting legs 58 of each end piece 40 into an upper slot 26 or lower slot 28 in panels 12. Plates 52 and 54 will snugly hold panel 12 in position. The spacing of ties 10 will depend upon the thickness and height of the wall to be poured. In general however, the horizontal distance between the ties is less than the thickness of the wall to be poured.

Each panel 12 is approximately one foot in height and has horizontally spaced ties along its top and bottom edges in order to form a one-foot high "block". Each block is thereby formed of a pair of panels 12 and an upper and lower row of ties 10. The blocks may be of any desired length. Each block locks on to the upper, lower and/or side edges of other blocks via the tongues 22 and grooves 24—the ties 10 holding the joints between the upper 14 and lower 16 edges of the blocks securely in alignment.

Because ties 10 are comprised of a connectable pair of halves 10*a* and 10*b*, it is possible to adjust the thickness of the wall to be poured at the site, as desired. Tie 10 also allows a wall to be poured around an existing pipe or conduit, since each half of the wall may be constructed on each side of the pipe and then the tie halves 10*a* and 10*b* connected together around the pipe.

Another new feature of the present invention is its use in combination with a smooth-sided extruded polystyrene panel. As was discussed in the background of the invention, the prior art panels utilized a corrugated or striated surface in engagement with the concrete to assist in adhering the panel to the concrete wall. However, such a panel cannot be removed if an exposed concrete surface is desired on the wall. The inventor has found that an extruded smooth-sided panel will not adhere to the wall and is easily removable and reusable.

In order to remove panels 12 from the wall to leave an exposed surface, the exterior plates 52 of each tie 10 are cut off the end of the ties 10. Because ties 10 are composed of a plastic material, this is easily accomplished using a scraper tool or the like and applying a quick sharp blow to the tie plate 52. Panels 12 will then slide perpendicularly out from the wall and ties 10, legs 58 sliding out through slots 26 and 28. The protruding plate 54 and legs 58 of ties 10 are then removed with a scraper tool in the same fashion. The small cross section of legs 44 and 46 of ties 10 are unnoticeable.

Figure 4:
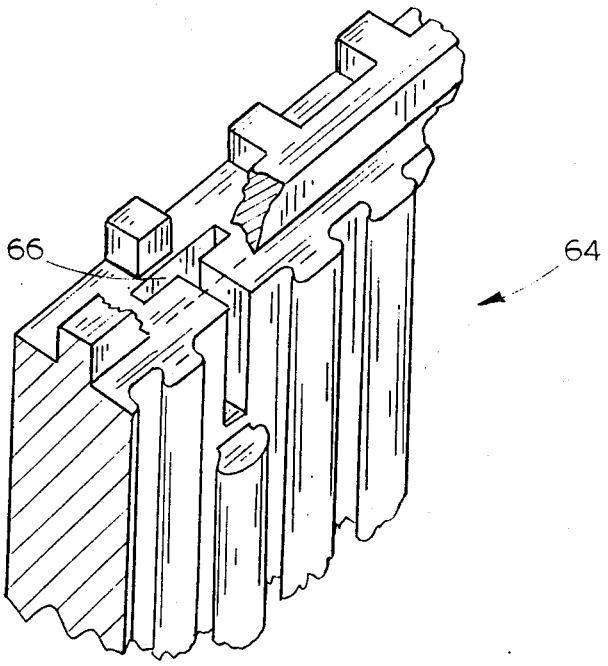
FIG. 4 (PRIOR ART)
FIG. 4 is a perspective view of a prior art insulated panel form used to form poured concrete walls.

Another advantage of the new tie 10 is in its capability of use with prior art panel designs 64, one of which is shown in FIG. 4. In this case, the outer plate 52 and a portion of legs 58 are inserted within T-shaped slots 66 of panel 64. This feature not only allows construction of walls with prior art materials already available, but also allows the use of a prior art panel 64 on one side of a wall and the new, extruded smooth panel 12 (described above) on the opposite side of the wall. This permits great latitude and variety in the desired surface treatment of a poured concrete wall.

Figure 5:
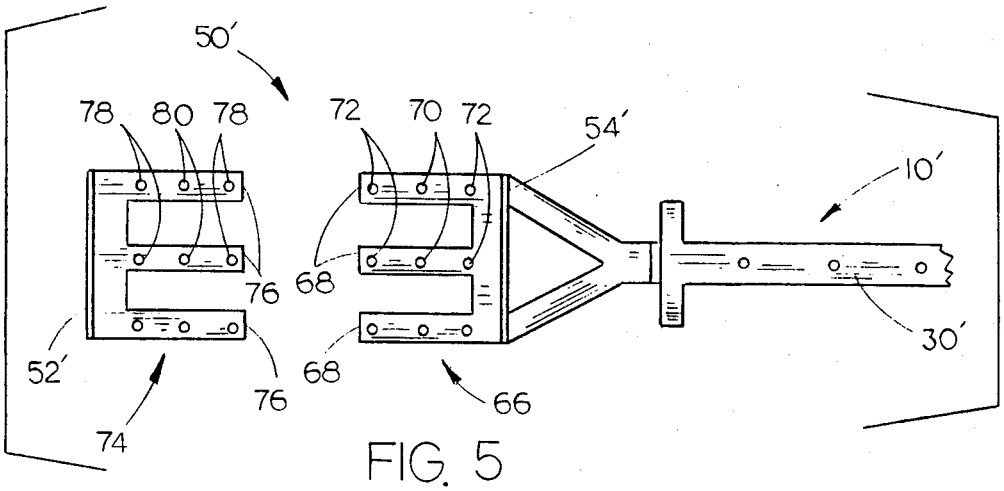
FIG. 5 is a side view of one end of a second embodiment of the invention.
Figure 6:
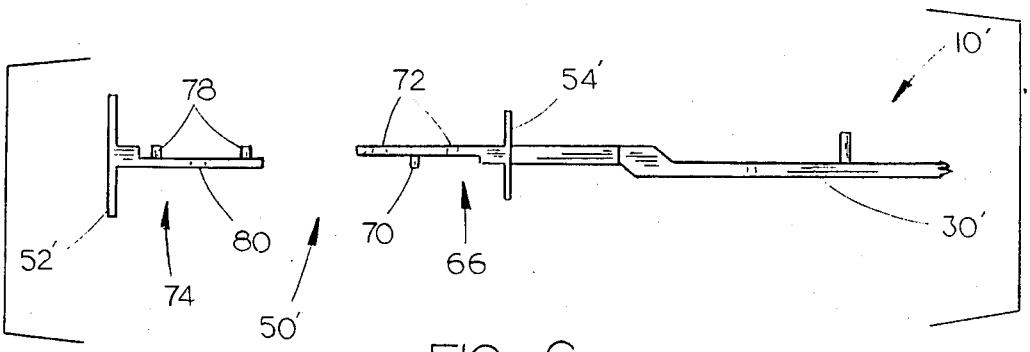
FIG. 6 is a top view of the tie of FIG. 5.

Referring now to FIGS. 5 and 6, another embodiment of the tie 10 of this invention is disclosed generally at 10', wherein the end section 50' consists of two adjustably connected pieces. The inner piece 66 includes plate 54' and is attached to strap 30' and has a set of legs 68 with a series of pegs 70 and apertures 72 arranged in alternating sequence, as seen in the drawings. Outer piece 74 has a corresponding set of legs 76 with a corresponding series of apertures 78 and pegs 80. Inner and outer pieces 66 and 74 are thereby connectable at different lengths, such that the distance between plate 52' and 54' is adjustable. It can be seen that this allows use of tie 10' with a variety of thicknesses of panels 12.

It can therefore be seen that the above-described invention fulfills at least all of the above-stated objectives.

I claim:

1. A tie for interlocking parallel and spaced-apart form panels, comprising:

an elongated strap means having first and second ends;

said strap means having a pair of diverging leg members projecting from each said end within a generally vertical plane;

an inner and outer plate member mounted to the free ends of each said pair of diverging leg members, said plate members being in parallel planes perpendicular to the longitudinal axis of said elongated strap means; and at least two leg members mounted between said inner and outer plate member at each end, affixing said plate members in spaced-apart, parallel relation at a distance to retain a form panel therebetween.

2. The tie of claim 1, wherein said elongated strap means includes a pair of cooperable first and second straps having means for selectively connecting said straps to form a single elongated strap having said first and second ends.

3. The tie of claim 2 wherein said means for connecting said straps includes a series of alternating spaced pegs and apertures on each of the pair of straps, said pegs and apertures cooperable between said pair of straps.

4. The tie of claim 1 wherein said leg members between said inner and outer plate means are spaced apart and located within the same vertical plane.

5. The tie of claim 1 wherein each said pair of diverging legs are located within the same vertical plane.

6. A tie for interlocking parallel and spaced-apart form panels, comprising:

first and second strap members having inner and outer ends;

means on said first and second strap members for connecting said inner ends of said strap members together to form a single elongated strap, said outer ends of said first and second strap members forming first and second opposing ends of said single elongated strap when said first and second straps are connected together;

said outer ends of said first and second strap having a pair of diverging leg members projecting therefrom within a generally vertical plane;

an inner and outer plate member mounted to the free ends of each said pair of diverging leg members, said plate members being in paprallel planes perpendicular to the longitudinal axis of said strap; and at least two leg members mounted between said inner and outer plate mean at each said end, affixing said plate means in spaced-apart, parallel relation at a distance to retain a form panel thickness therebetween.

7. The tie of claim 6 wherein said leg members between said inner and outer plate members are spaced apart and within the same vertical plane.

8. A tie for interlocking parallel and spaced-apart form panels comprising:

first and second strap members having inner and outer ends;

means on said strap members for connecting the inner ends of said strap members together to form a single elongated strap, said outer ends of said first and second strap members forming first and second opposing ends of said single elongated strap when said first and second straps are connected together;

said outer end of each said first and second straps having a pair of diverging leg members projecting therefrom within a generally vertical plane;

an inner and outer plate member mounted to the free ends of each said pair of diverging leg members, said plate members in parallel planes perpendicular to the longitudinal axis of said strap;

first upper and lower leg members mounted on each said outer plate and extending toward said inner plate means, said upper and lower leg members parallel and spaced-apart within the same vertical plane;

second upper and lower leg members mounted on each said inner plate and extending towards said outer plate, said second and lower leg members being parallel and spaced-apart within the same vertical plane; and means on said first and second upper and lower leg members for connecting said first and second upper leg members together and for connecting said first and second lower leg members together, such that the distance between said inner and outer plate means is adjustable.

* * * * *